United States Patent [19]

Bell

[11] 4,171,801

[45] Oct. 23, 1979

[54] FRICTIONAL ARM EXERCISE DEVICE

[76] Inventor: Dean E. Bell, 1716 Meyers La., Louisville, Ky. 40216

[21] Appl. No.: 871,971

[22] Filed: Jan. 24, 1978

[51] Int. Cl.[2] ..... A63B 21/00

[52] U.S. Cl. ..... 272/67; 272/132

[58] Field of Search ..... 272/67, 72, 132, 136, 272/131, 143, 142, 73, DIG. 3, DIG. 4; 73/381, 379; 188/84, 72.9, 67

[56] References Cited

U.S. PATENT DOCUMENTS

| | | | |
|---|---|---|---|
| 2,819,081 | 1/1958 | Touraine | 272/67 |
| 3,013,799 | 12/1961 | Wise | 272/132 |
| 3,428,311 | 2/1969 | Mitchell | 272/67 |
| 3,563,542 | 2/1971 | Wellman | 272/67 X |
| 3,633,907 | 1/1972 | Cane | 272/67 X |
| 3,662,602 | 5/1972 | Weiss | 272/67 X |
| 4,007,927 | 2/1977 | Proctor | 272/132 X |

*Primary Examiner*—Richard C. Pinkham
*Assistant Examiner*—William R. Browne
*Attorney, Agent, or Firm*—Harry B. O'Donnell, III

[57] ABSTRACT

An arm exercise device that is compact and portable for strengthening either arm through arm wrestling exercises. There is a base member supporting bearing mechanism of a shaft member. A handle is transversely disposed on the shaft and is movable through an angle of about 180°. The free end of the handle is provided with a hand-grip that is pivotally connected thereto, and the hand-grip is also reversible to either side of the handle. An adjustable frictional brake mechanism is furnished with the shaft to resist the turning force exerted on the handle by the arm.

4 Claims, 3 Drawing Figures

FRICTIONAL ARM EXERCISE DEVICE

BACKGROUND OF THE INVENTION

This invention relates to body exercising apparatus, and, more particularly, to equipment for exercising the arms and hands while performing arm wrestling exercises.

Several forms of arm wrestling exercising devices have been provided in the past.

U.S. Pat. No. 929,281 shows an arm wrestling exercising and muscle-testing machine for the right arm only. A facsimile of a human forearm and hand is vertically arranged and pivotally connected to a vertical base member in the position of an arm wrestler. Spring means are provided to resist the turning motion of the pivoted forearm from a generally vertical starting position. A dashpot is also provided to prevent a sudden reverse movement of the forearm after it has been pinned down to the table and suddenly released.

U.S. Pat. No. 2,782,033 describes a wrist and forearm exerciser which employs a rocker device that is attached to the table and is furnished with long, heavy-duty springs to resist the turning motion of the rocker device. The rocker device is furnished with a pair of hand grips. A person may exercise both arms by using both sides of the table, or may stand at the end of the table and pull both hand grips simultaneously. This prior-art device has a fixed hand grip which is not capable of being adjusted to accommodate people of different sizes.

U.S. Pat. No. 3,633,907 illustrates a compact arm exercising device that has an elongated swing arm with a plurality of heavy-duty springs fastened between the arm and the table to resist the pulling force exerted by the hand grip upon the swing arm. Its springs are not in tension until the swing arm reaches near its vertical position.

U.S. Pat. No. 3,662,602 shows an arm wrestling exerciser with a base that includes a handle for universal movement. A disc-shaped reference plate with a semicircular periphery is pivotally mounted upon the base. Springs interconnect the reference plate and the handle for biasing the handle. The handle is capable of movement in a second direction transversely of the direction of reference plate displacement. The reference plate may include a graduated scale to serve as a datum so that a user may know with precision his exercising progress.

The present invention is directed toward providing a novel arm exercising device which is compact and portable and with which the position of the handgrip is adjustable to approximate the feel and action of an arm wrestling adversary. Moreover, the resistance to movement of the hand-grip is controllable by adjustable brake means.

SUMMARY OF THE INVENTION

The present invention provides a compact, arm exercise device having a base member with bearing means that support a shaft for rocking movement therein. A generally transverse handle means is joined to the shaft and movable therewith. A hand-grip means is pivotally connected to the top portion of the handle means. An adjustable brake means cooperates with the shaft for resisting the turning motion of the handle means. The hand-grip may be reversible so it may be engaged and operated by either hand from the same position.

BRIEF DESCRIPTION OF THE DRAWINGS

This invention will be better understood from the following description taken in conjunction with the accompanying drawings, and its scope will be pointed out in the appended claims.

DETAILED DESCRIPTION

Figure 1:
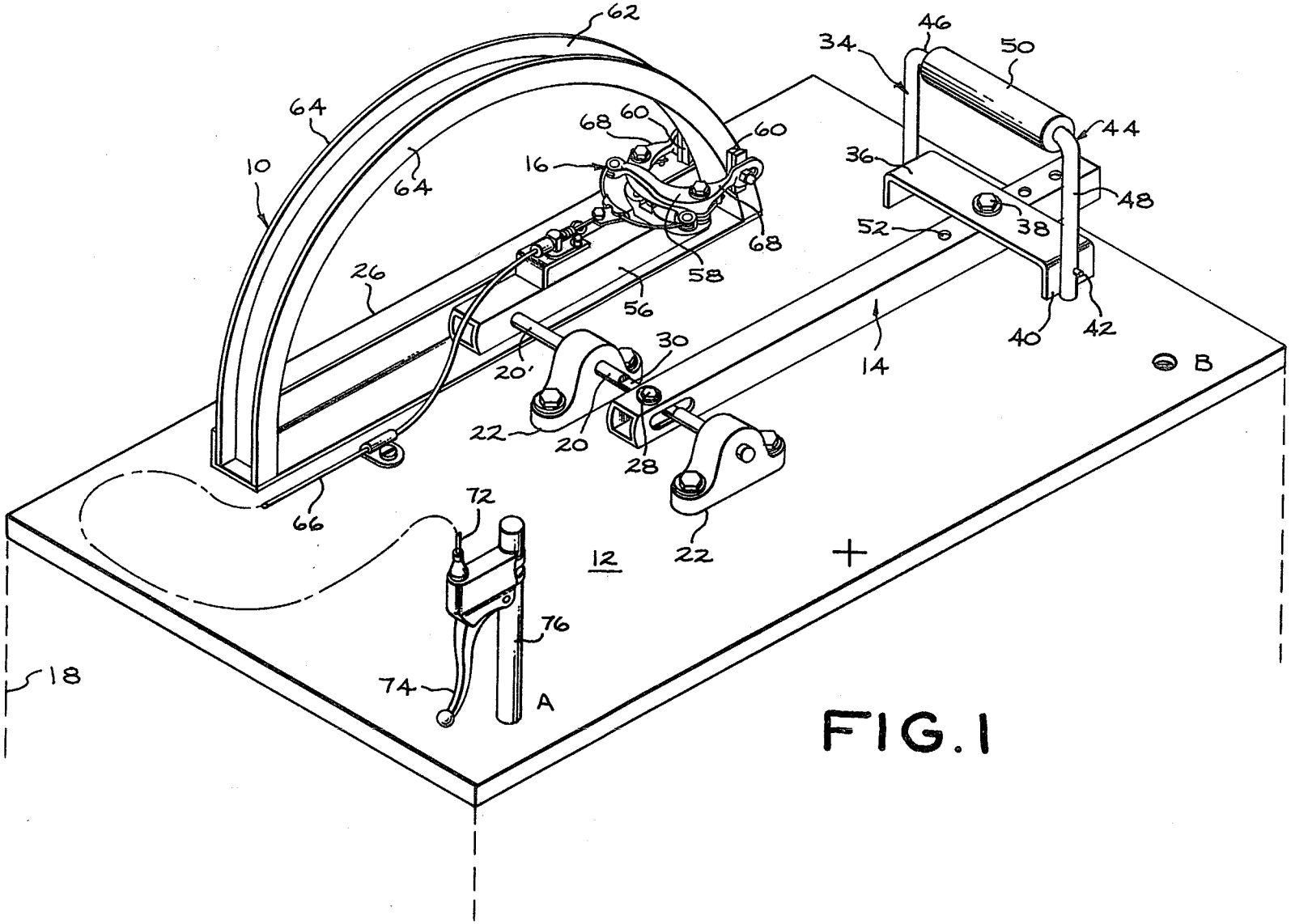
FIG. 1 is a top perspective view of a presently preferred form of the arm exercise device of the present invention shown in a rest position, and set for use in exercising the right arm in an arm wrestling mode. An adjustable brake means is also shown in combination with an arcuate or semi-circular brake rim, where the brake is remotely controlled by the other hand of the user.
Figure 2:
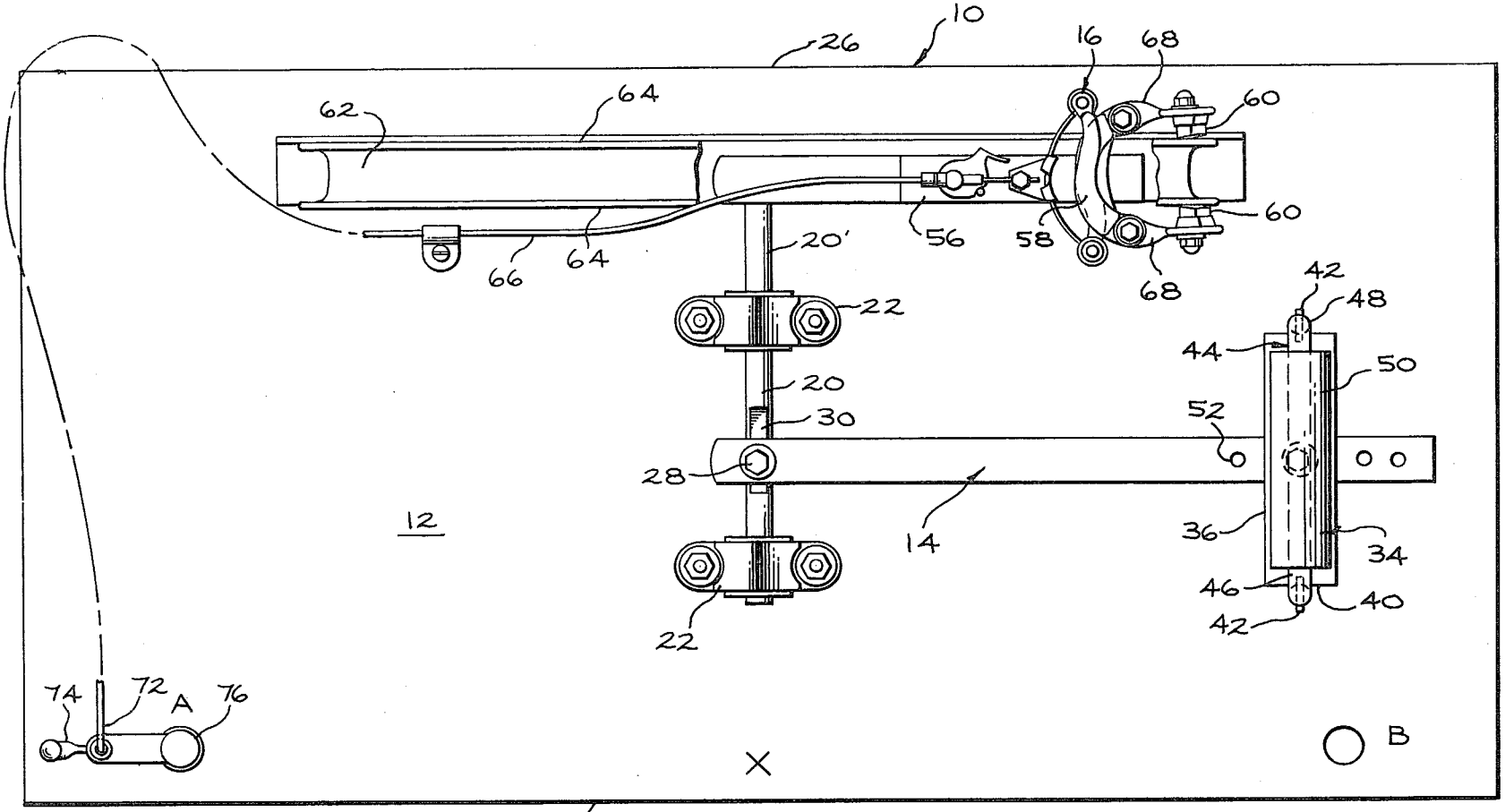
FIG. 2 is a top plan view of the device shown in FIG. 1 showing a flexible cable joining the brake mechanism to a remote brake-operating handle at the left side of the exercise table.

Turning now to the drawings, and in particular to drawing FIG. 1, there is shown a presently preferred form of a novel arm exercise device 10 that is provided in accordance with the present invention. Basically, it comprises three main elements: a base member 12; a pivoted handle member 14; and an adjustable brake means 16 for retarding the pivotal movement of the handle. The base member 12 is a wide board which may be carried from place to place and mounted on a table top or work bench when the arm exercise device is to be used. Or, alternatively, the base member may be fixed permanently as part of a table, work bench, counter top 18 or other supporting structure.

A shaft 20 is supported from the base 12 by a pair of bearing blocks 22, 22 for oscillating movement. The shaft is generally in the center portion of the base, and it extends towards the front edge 24 of the base as well as toward the base rear edge 26. The handle 14 is joined to the shaft 20 in the area between the two bearing blocks 22, 22 by a pivot bolt 28 which extends completely through the handle. Shims (not shown) may be installed within the end of the handle to bear against flat sides 30 of the shaft and restrict any play of the handle relative to the shaft, except in the plane of the handle about the pivot bolt 28. Preferably, this pivot bolt 28 is tightened to form a stiff pivot means so the handle cannot pivot of its own weight, but may pivot at will through a small angle when moved by the user.

At the upper portion of the handle 14 there is a hand-grip member 34 that is pivotally connected to the handle by means of a mounting plate 36 and a pivot bolt 38. This bolt 38 is also tightened to form a stiff pivot means such that the hand-grip 34 will not pivot of its own weight, but may pivot at will through a small angle when moved by the user. The mounting plate 36 has a downturned flange 40 at each end to receive a pivot pin 42. The hand-grip 34 includes a bar 44 of U-shape, having a mid-portion 46 and parallel end portions 48, 48. These end portions 48, 48 are fastened to the mounting plate 36 by means of the pivot pins 42, 42. With this arrangement, the pivotal axis of the pivot bolt 38 and the pivotal axis of the two, in-line pivot pins 42, are perpendicular to each other, and thus, together, form a universal connection between the hand-grip 34 and the handle 14. The mid-portion 46 of the bar 44 of the hand-grip 34 is preferably furnished with a loose, elongated roller 50 for engagement by the user's clenched fist. Adjustment holes 52 may be added to the end of the handle 14 to allow the mounting plate 36 to be either raised or lowered on the handle to accommodate both adults and children in using this arm exercise device 10.

In use, the user would normally position himself in a chair directly in front of the front edge 24 of the base member 12. Then, the user would grasp the roller 50 with his right hand and raise the handle 14 to its upright position so as to begin an arm wrestling type of exercise. The user's right elbow would be positioned on the base member 12 generally where X marks the spot, in-line with the pivotal axis of the oscillating shaft 20. As the handle 14 is moved from its right hand end position, as shown in FIG. 1, through 180° to its left hand end position, and with the user's elbow planted firmly on the base 12 where X marks the spot, it will be understood that the hand-grip 34 will pivot about its universal connection 38, 42 and 50 to naturally accommodate the user's grip so as not to raise the user's elbow off of its resting position at X.

Figure 3:
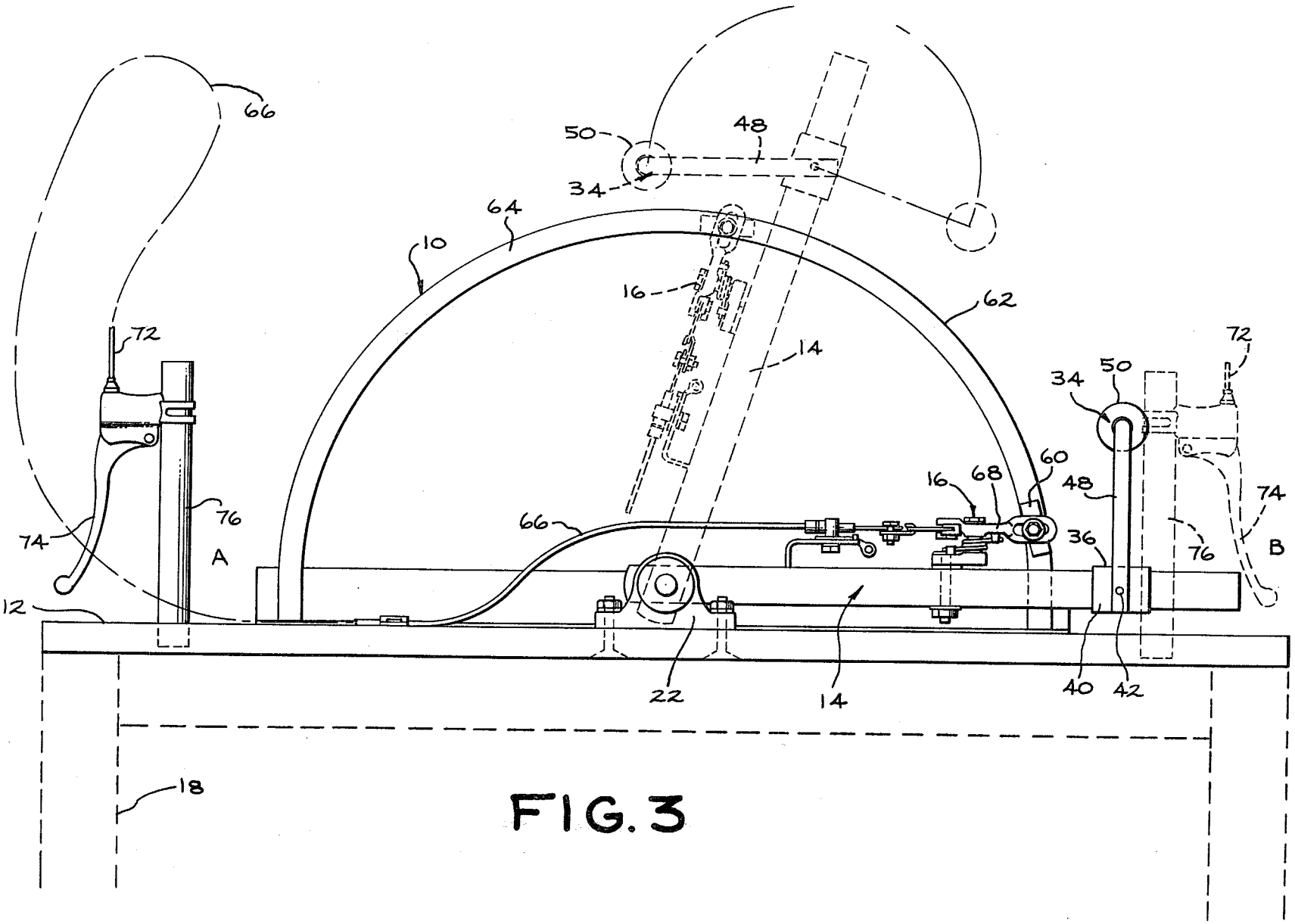
FIG. 3 is a front elevational view of the device illustrated in FIGS. 1 and 2 showing in phantom lines the hand-grip and handle pivoted up to a near vertical position, which further shows that the brake shoes are movable along with the handle. Also shown in phantom lines at the right side of FIG. 3 is the alternate position of the brake-operating handle for use by the right hand when the hand-grip is reversed on the handle for exercising of the left arm.

Notice in FIG. 3 that the hand-grip member 34 is reversible on the handle member 14, in that the U-shaped bar 44 may be swung over the end of the handle as is shown in dotted lines. Then the hand-grip would be repositioned so the roller 50 would be at the proper angle to receive the person's clenched fist of the left hand when the left elbow is planted at the X spot on the base 12.

It is important to be able to apply a certain amount of restraint to the movement of the handle against which the person's arm must compete. It is also well to be able to vary the amount of the restrain in a simple, quick and convenient manner depending upon the strength or size of the persons' arms to be exercised.

As mentioned earlier, the adjustable brake means 16 serves to retard or restrain the pivotal movement of the handle. The brake means 16 comprises a shaft extension 20', a rigid arm 56 fastened to the shaft extension, a caliper brake mechanism 58 with opposing brake shoes 60 all supported from the free end of the arm 56 for cooperation with a semi-circular brake rim 62 having dual braking surfaces 64 that are clamped between the brake shoes 60. A flexible choke cable 66 is provided for the caliper brake 58 for actuating the two caliper arms 68, 68 of the brake mechanism 58. This choke cable 66 provides a remote control means for the caliper brake mechanism 58.

At the opposite end 72 of the choke cable 66 is an operating handle 74 that is attached to one end to a mounting post or bar 76. This mounting post 76 may be unattached to the base 12 and merely grasped by the free hand, or the post may be mounted upright at several possible positions on the base member 12. See FIG. 3, wherein POSITION A at the left side of the base is for operation by the left hand when the right arm is being exercised on this exercise device. Alternate POSITION B is at the right side of the base and is for engagement by the right hand when the left arm is being exercised.

Thus during an exercise, both arms are being used, one to apply the braking means and the other to overcome the braking means.

Arm wrestling is an activity requiring two people, a place where these two people can face each other, set their elbows down, grasp each other's hand while their arms are generally in a vertical position, and enough room to allow each person to force the other person's arm down to nearly a horizontal position.

One important use of the present device of the ambidextrous arm exercise device of the present invention is to simulate the opposition of one of the arm wrestlers. This allows a person to practice or train for arm wrestling competition by themselves.

It should be apparent to those skilled in the art that while there has been described what presently is considered to be a presently preferred embodiment of this invention in accordance with the Patent Statutes, changes may be made in the disclosed device without actually departing from the true spirit and scope of this invention. It is therefore intended that the appended claims shall cover such modifications and applications that may not depart from the true spirit and scope of the present invention.

What is claimed is:

1. An arm exercise device, comprising:

(a) a base;

(b) a bearing mechanism mounted on said base and journalling a shaft for pivotal movement with respect to said base;

(c) a generally transverse handle joined to said shaft and movable therewith;

(d) a hand-grip joined to the handle near the top portion thereof; and (e) an adjustable brake mechanism for resisting said pivotal movement of said shaft, (f) said brake mechanism including a fixed brake member and a movable brake member with said fixed brake member being releasably engaged by said movable brake member, (g) said fixed brake member being mounted on said base and said movable brake member being interconnected to said shaft for movement therewith, said movable brake member being movable through an arc and substantially within the plane described by the shape of said fixed member and (h) said fixed brake member comprising an arcuate member, and said movable brake member comprising remotely controlled friction brake shoes.

2. The invention of claim 1, wherein the said arcuate member has brake surfaces which are substantially equidistant from the longitudinal axis of the said shaft.

3. The invention of claim 2, wherein the said remotely controlled friction brake shoes operate against opposite sides of the arcuate fixed brake member, and cable means for operating the friction brake shoes.

4. The invention of claim 2, wherein the said cable means has at the end that is remote from the friction brake shoes a bar and a pivoted handle for adjusting the tension on the friction brake shoes.

* * * * *